US005569864A

United States Patent [19]

Hamanaga et al.

[11] Patent Number: 5,569,864

[45] Date of Patent: Oct. 29, 1996

[54] MUTE ATTACHED TO BRASS INSTRUMENT WITHOUT CHANGE OF PITCH OF SOUND

[75] Inventors: Shinji Hamanaga; Yoshihiko Matsukuma, both of Shizuoka, Japan

[73] Assignee: Yamaha Corporation, Japan

[21] Appl. No.: 557,455

[22] Filed: Nov. 14, 1995

[30] Foreign Application Priority Data

Nov. 14, 1994 [JP] Japan ..... 6-278893
Aug. 25, 1995 [JP] Japan ..... 7-217374

[51] Int. Cl.[6] ..... G10D 9/06
[52] U.S. Cl. ..... 84/400
[58] Field of Search ..... 84/400, 453

[56] References Cited

U.S. PATENT DOCUMENTS 3,555,956 1/1971 Martin ..... 84/400
3,760,679 9/1973 Gossick et al. ..... 84/400
4,226,162 10/1980 Ebach ..... 84/400
4,273,021 6/1981 Mackie ..... 84/400
4,273,022 6/1981 Bell ..... 84/400
5,309,808 5/1994 Tarrant ..... 84/400

FOREIGN PATENT DOCUMENTS 2-119697 9/1990 Japan .
2-34716 9/1990 Japan .

*Primary Examiner*—Patrick J. Stanzione
*Attorney, Agent, or Firm*—Ostrolenk, Faber, Gerb & Soffen, LLP

[57] ABSTRACT

A mute attached to a brass instrument has an inner surface shaped in such a manner that standing waves of representative harmonic tones have respective final nodes therein close to final nodes of the standing waves generated without the mute, and the pitch of the sound is hardly changed between a performance with the mute and a performance without a mute.

14 Claims, 10 Drawing Sheets

MUTE ATTACHED TO BRASS INSTRUMENT WITHOUT CHANGE OF PITCH OF SOUND

FIELD OF THE INVENTION

This invention relates to a mute available for a brass instrument and, more particularly, to a mute allowing a player to practice without a change of pitch of the sound.

DESCRIPTION OF THE RELATED ART

Conventionally, a mute is used for the variety of a musical expression. For example, a player temporally attaches the mute to a brass instrument so as to change the timbre of the brass instrument in the performance. Acoustic musical instruments usually generate loud sounds, and sometimes disturb the neighbors. This means that players need a soundproof chamber. However, if a mute is available for the acoustic musical instrument, the player can practice the acoustic musical instrument at home without complaint.

FIG. 1 illustrates a prior art mute available for a brass instrument, and the prior art mute is disclosed in Japanese Utility Model Publication of Unexamined Application No. 2-119697.

The prior art mute I is attached to a brass instrument 2 such as a trumpet, and comprises a cylindrical case 1*a* and a flat head member 1*b*. The flat head member 1*b* closes one end of the cylindrical case 1*a*, and the inner space is open at the other end to the brass instrument 2. The prior art mute 1 further comprises an inner sound absorbing layer 1*c* laminated on the inner surface of the cylindrical case 1*a* and the inner surface of the bottom plate 1*b*, and a hole 1*d* is formed through the cylindrical case 1*a* and the sound absorbing layer 1*c*. The hole 1*d* allows the air to flow between the inner space and the outside of the mute 1.

The prior art mute 1 further comprises a microphone 1*e* inserted into the inner space, and the microphone 1*e* is connected through wires If to a headphone 1*g*.

The bell 2*a* of the brass instrument is inserted into the inner space of the cylindrical case 1*a*, and a player blows on the mouthpiece (not shown). The air column vibrates, and generates sound. The hole 1*d* allows the blow to escape therethrough. The sound is confined in the prior art mute 1, and is absorbed by the sound absorbing layer 1*c*. The sound merely leaks through the hole 1*d*.

The microphone 1*e* picks up the sounds, and allows the player to hear the sounds through the headphone 1*g*.

Another prior art mute 3 is illustrated in FIG. 2 of the drawings, and is inserted into a bell 4*a* of a brass instrument. The prior art mute 3 is fabricated from a flare tube member 3*a* of aluminum, a round head 3*b* also formed of aluminum and a sealing liner 3*c* of cork. The flare tube member 3*a* has a frusto-conical configuration, and the round head 3*b* is fixed to one end of the flare tube member 3*a* so as to form an inner space 3*d* open at the other end of the flare tube member 3*a*. A small hole 3*e* is formed in the flare tube member 3*a*, and conducts the inner space 3*d* to the outside of the mute 3. The sealing liner 3*c* is wound on the outer surface of the other end portion of the flare tube member 3*a*, and seals the air inside of the brass instrument and the prior art mute 3.

When a player wants to practice the brass instrument with reduced sounds, he inserts the prior art mute 3 into the bell 4*a* of the brass instrument 4, and connects the inner space 3*d* to the inner space of the brass instrument 4. While he is blowing on the brass instrument, the air column vibrates so as to generate a sound, and the pitch of the sound is changed depending upon the length of the air column. The blow escapes through the small hole 3*d* only. The sound is confined in the inner space 3*c* of the prior art mute 3, and leaks through the small hole 3*e* only.

FIG. 3 illustrates yet another prior art mute 5 inserted into a bell 6*a* of the brass instrument 6. The prior art mute 5 is like the prior art mute 3, and comprises a flare tube member 5*a*, a round head 5*b* attached to one end or the flare tube member 5*a* and a sealing liner 5*c* attached to the outer surface of the other end portion of the flare tube member 5*a*. The flare tube member 5*a* and the round head 5*b* form an inner space 5*d*, and is connectable to the inner space of the brass instrument 6. The prior art mute 5 differs from the prior art mute 3 in a short tube member 5*d* inserted into an opening 5*f* formed in the round head 5*b*, and the inner space 5*d* is conducted through the short tube member 5*d* to the outside of the prior art mute 5.

A player inserts the prior art mute 5 into the bell 6*a* of the brass instrument 6 before a performance, and blows on the mouthpiece (not shown) of the brass instrument 6. The air column vibrates so as to generate a sound. The blow escapes through the short tube member 5*e*. Although the prior art mute 5 slightly reduces the sounds, the timbre is widely changed, enabling the player to impart unique musical expression to the sounds.

The prior art mutes 1, 3 and 5 encounter a problem in unstable intervals among the tones. In other words, even if a player exactly controls the blow on the mouthpiece and the length of the air column in accordance with a scale, the sounds reduced through the mutes 1, 3 and 5 are not on the scale.

The unstable intervals are derived from the inner walls of the flat/round heads 1*b*/3*b* substantially perpendicular to the respective center axes CL1/CL2 of the brass instruments 2 and 4 for the prior art mutes 1 and 3. The substantially perpendicular inner walls can not reflect the sounds at good balance, and fluctuate the intervals. Especially, low pitch sounds tend to be higher.

The unstable intervals of the prior art mute 5 is caused by the short tube member 5*e*. The short tube member 5*e* has a straight tube portion 5*f* inserted into the inner space 5*d* and a bell portion 5*g* open to the air. The straight tube portion 5*f* is constant in cross section, and the constant cross section changes the intervals.

The present inventors measured sound pressures of harmonic tones generated by a brass instrument with and without the prior art mute 3. The sound pressures of the harmonic tones were plotted in FIG. 4.

The broken lines BL1, BL2, BL3 and BL4 stand for the sound pressures of the second, fourth, sixth and eighth harmonic tones without the prior art mute 3, and real lines RL1, RL2, RL3 and RL4 represent the sound pressures of the harmonic tones with the prior art mute 3. The difference of the nodes is represented by dL.

The standing waves BL1 to BL4 and RL1 to RL4 strongly affect an actual tone. All of the standing waves BL1 to BL4 representative of the harmonic tones have respective final nodes a1, a2, a3 and a4 in the neighborhood of the open end of the bell, and the final nodes a1 to a4 are substantially matched with one another. This feature contributes the stability of the pitch of the sound.

However, the standing waves RL1 to RL4 representative of the harmonic tones change the position of the final nodes b1, b2, b3 and b4 along dots-and-dash line DDL, and the final nodes b1 and b2 take place in the tube member inside of the bell. This results in undesirable wave components. For example, the wave component c1 of a quarter of the wavelength is produced from the standing wave RL1, and is radiated from the brass instrument. The variation of the nodes b1 to b4 is not constant over the tone range, and either harmonic tone strongly affects the fundamental pitch of the sound depending upon the note of the sound.

The prior art mute 5 had the similar tendency as the prior art mute 3, and the unstable intervals are inherent in the prior art mutes 1, 3 and 5.

The prior art mutes 1, 3 and 5 further have individual problems.

The prior art mute 1 is expensive due to the attaching work on the sound absorbing layer 1*c* and the flare cylindrical member 1*a* together, and the sound absorbing layer 1*c* tends to be unsanitary due to water. Moreover, the small hole 1*d* imparts large resistance against the blow, and the player feels the blow unusual. The prior art mute 3 also gives large resistance against the blow due to the small hole 3*e*.

On the other hand, the prior art mute 5 merely insufficiently reduces the sounds, because the prior art mute 5 aims at the change of the timbre. The resistance against the blow is not small.

SUMMARY OF THE INVENTION

It is therefore an important object of the present invention to provide a mute which sufficiently reduces sounds without change of the intervals.

To accomplish the object, the present invention proposes to control reflection on an inner surface of a mute in such a manner as to match the distribution of sound pressures of harmonic tones with those of sound generated by a brass instrument without the mute.

In accordance with the present invention, there is provided a mute attached to a bell portion of a brass instrument, comprising: a case member including a first inner surface defining a first inner space having a first end connected to an air passage of the brass instrument and a second end open to the outside; and a frusto-conical tube member connected to the case member at the second end, and projecting into the first inner space, the frusto-conical tube member including a second inner surface defining a second inner space decreasing a cross section toward a leading end thereof.

The leading end of the frusto-conical tube member may be located at a position where the minimum sound pressure due to standing waves representative of predetermined harmonic tones featuring the brass instrument takes place.

The first inner space may increase a cross section thereof from the first end to a middle point and decrease the cross section thereof from the middle point to the second end.

The leading end may be farther from the second end than first points in the first inner space and closer to the second end than second points in the first inner space. The maximum sound pressures of harmonic tones of a sound generated by the brass instrument attached to the mute take place at the first points, and the final nodes of standing waves respectively representative of dispersions of sound pressures of said harmonic tones take place at the second points.

BRIEF DESCRIPTION OF THE DRAWINGS

The features and advantages of the mute according to the present invention will be more clearly understood from the following description taken in conjunction with the accompanying drawings in which.

Figure 1:
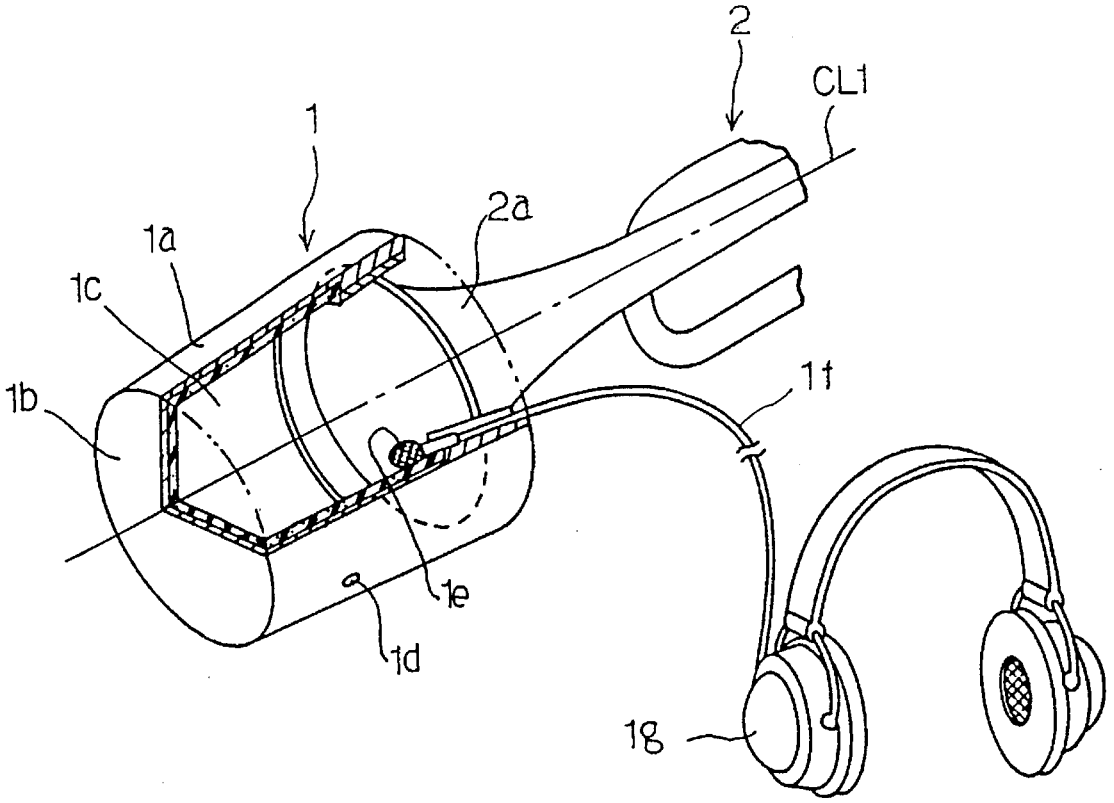
Fig. 1 PRIOR ART
FIG. 1 is a partially cut-away perspective view showing the prior art mute attached to the brass instruct.
Figure 2:
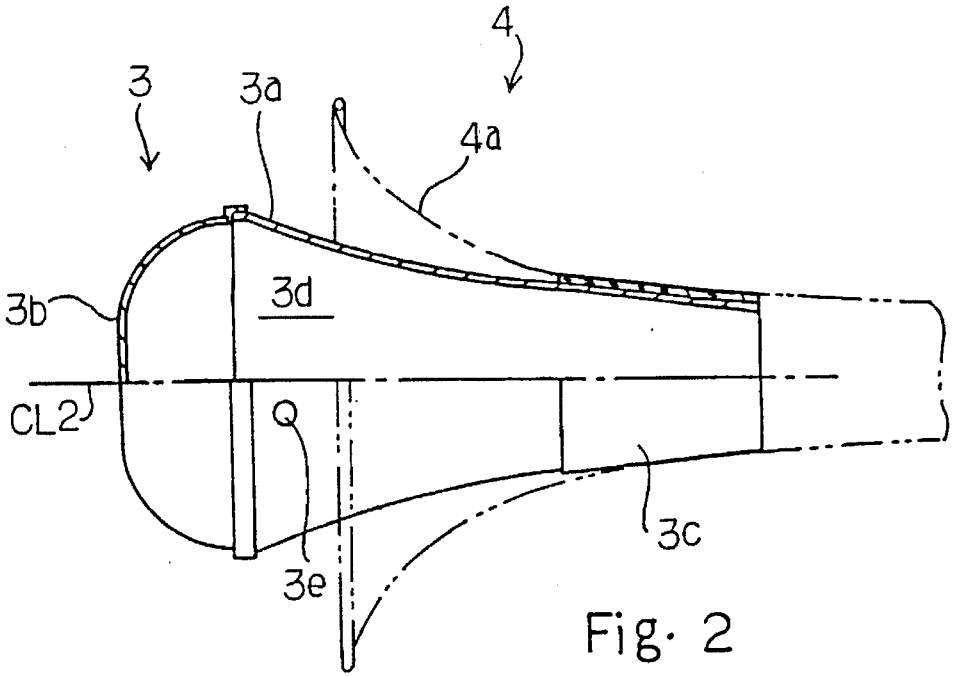
Fig. 2 PRIOR ART
FIG. 2 is a partially cut-away side view showing another prior art mute attached to the brass instrument.
Figure 4:
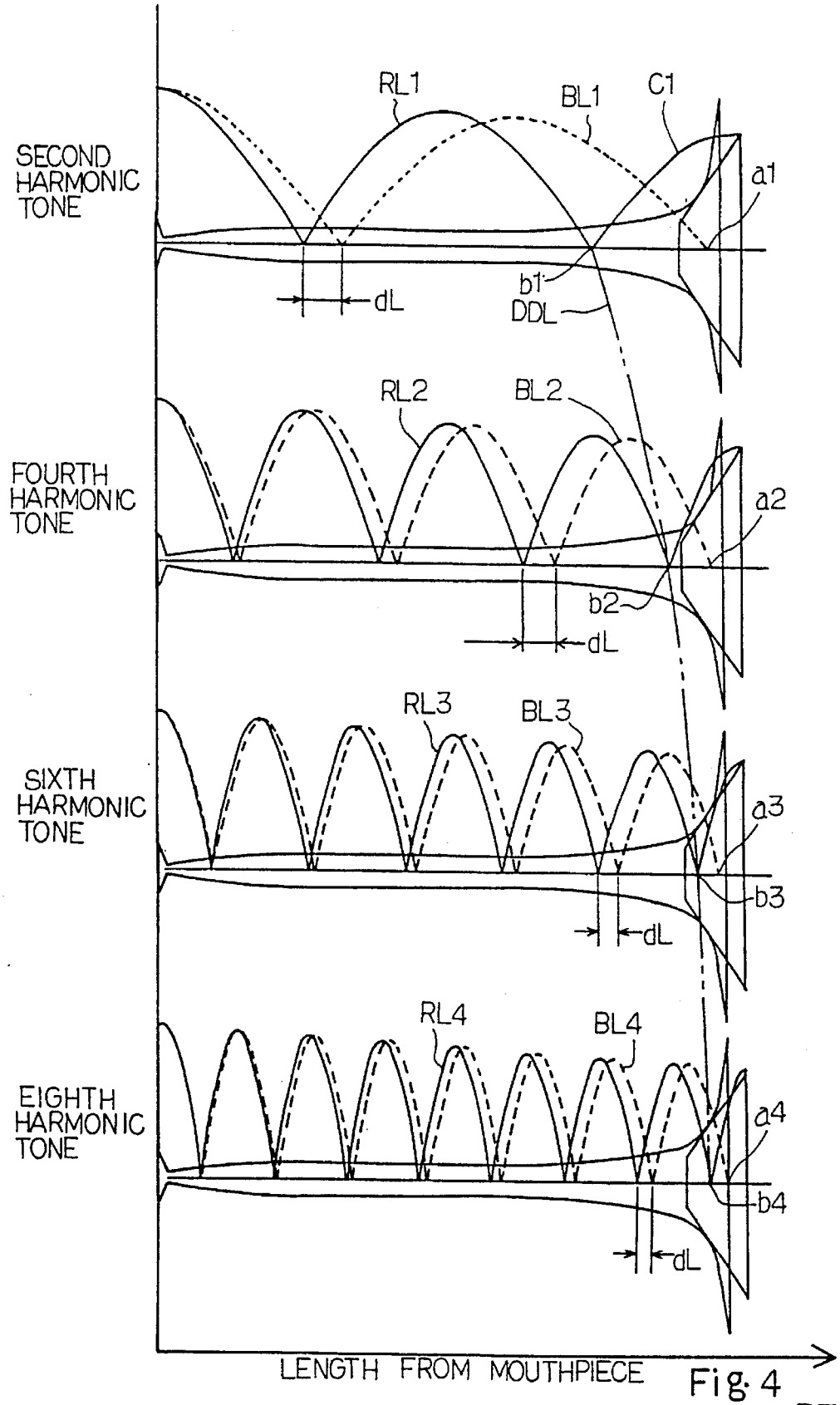
Fig. 4 PRIOR ART
Figure 5:
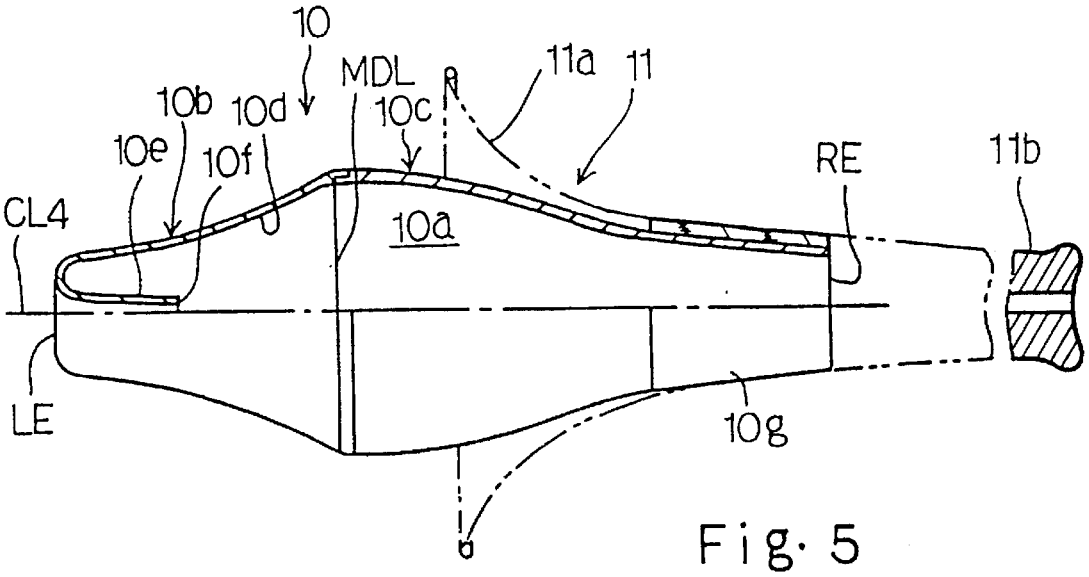
Figure 7:
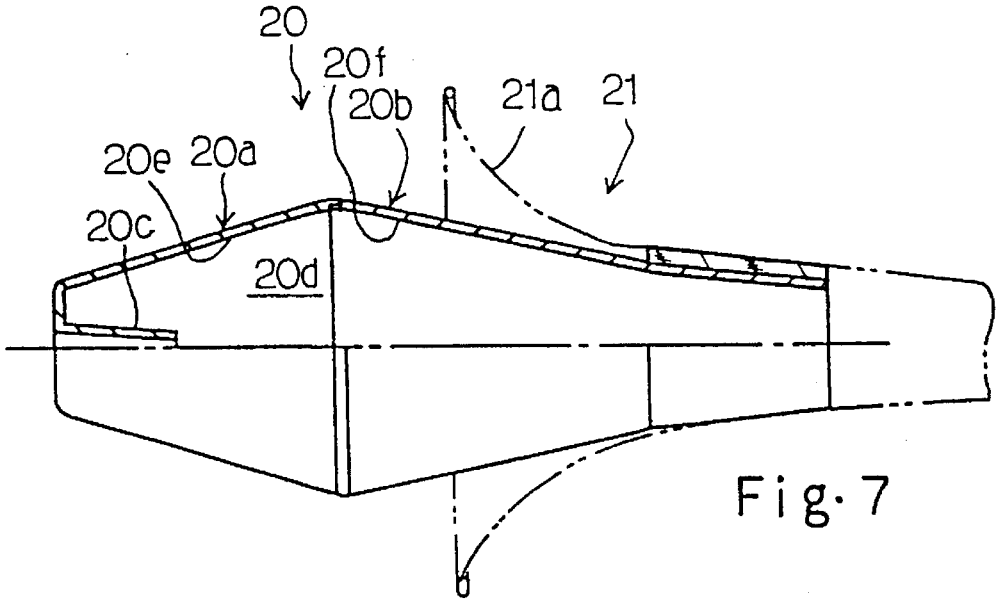
Figure 6:
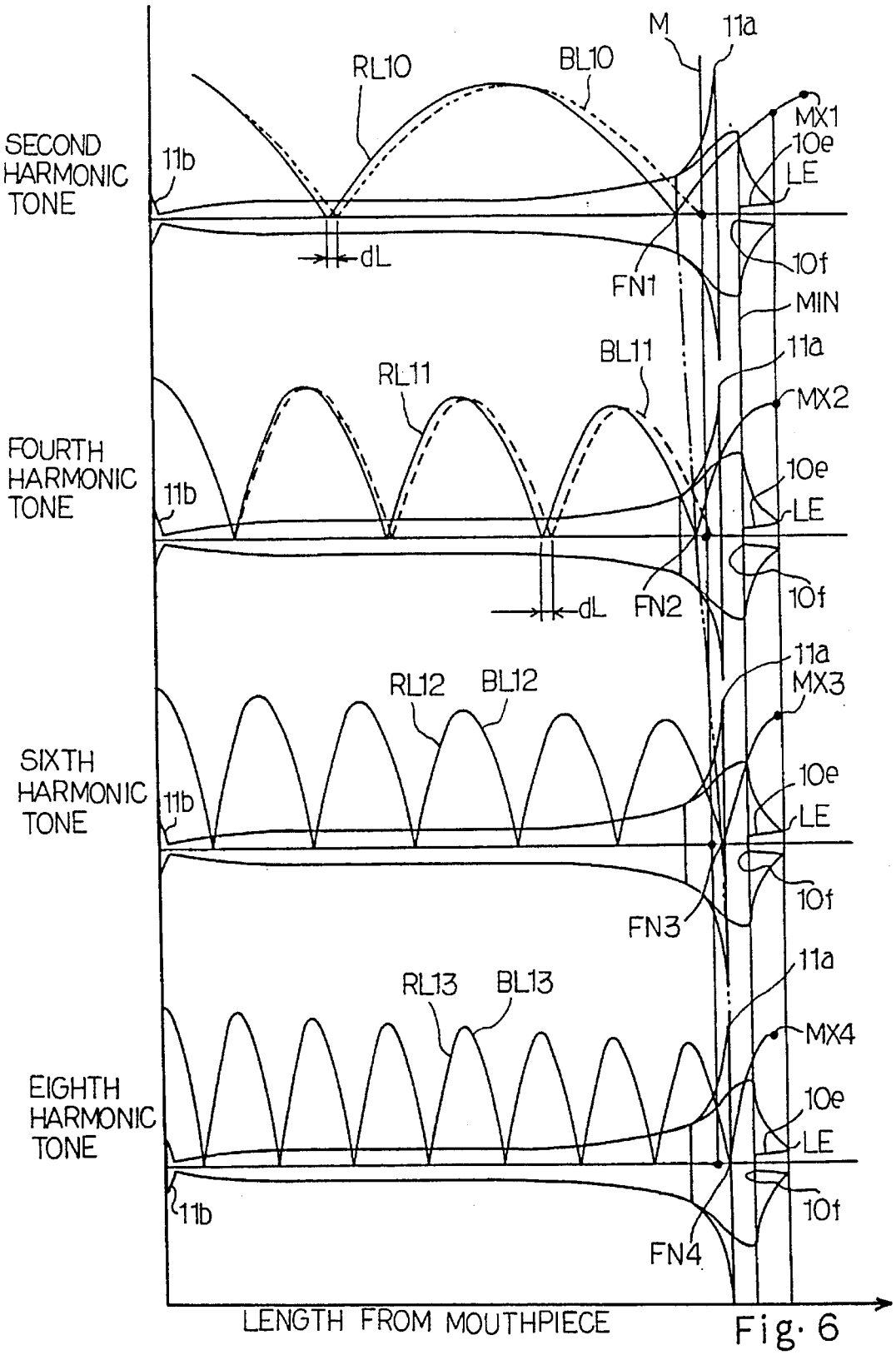
Figure 8A:
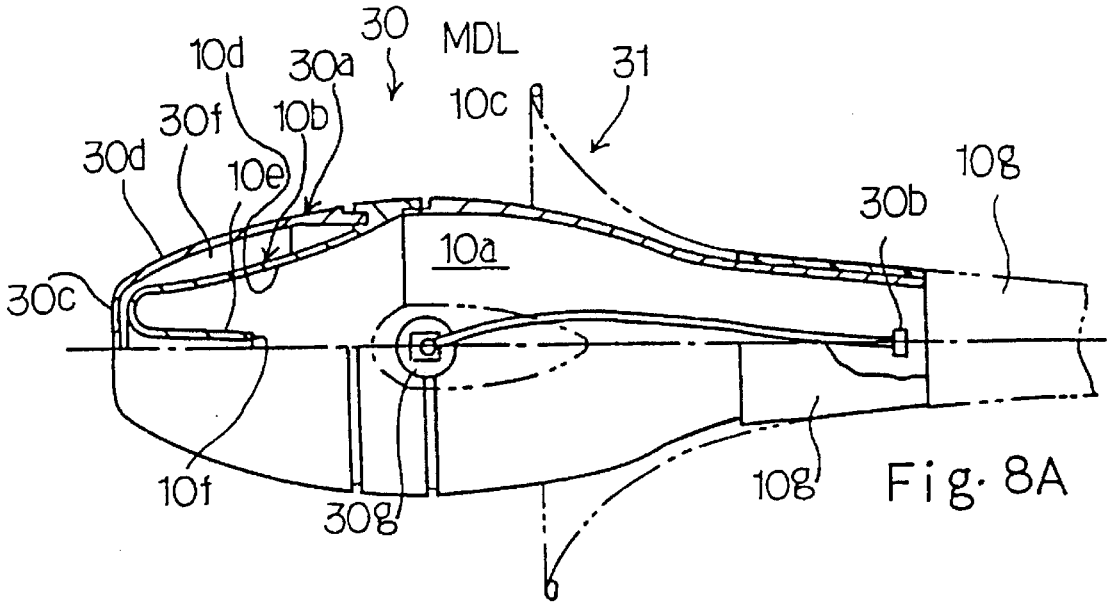
Figure 8B:
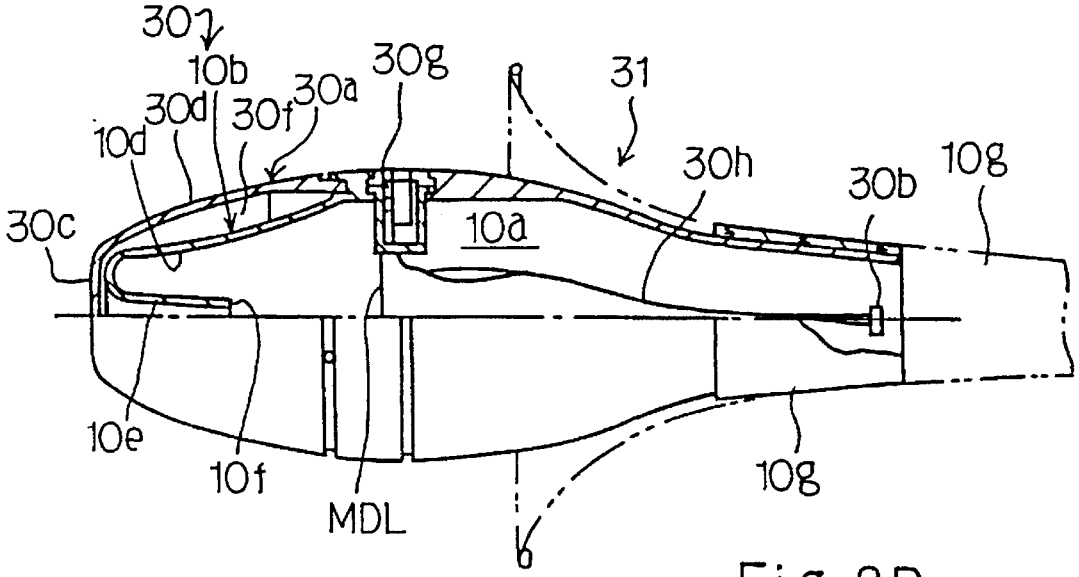
Figure 9:
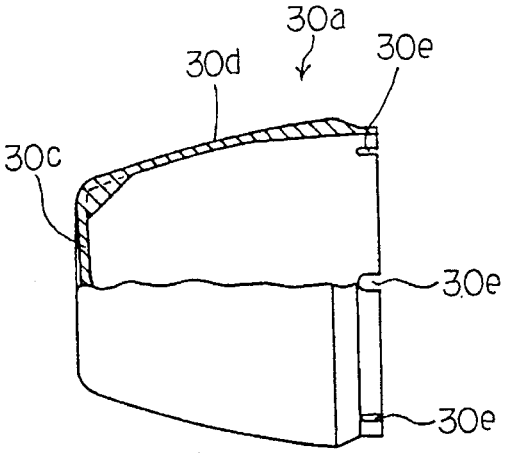
Figure 11:
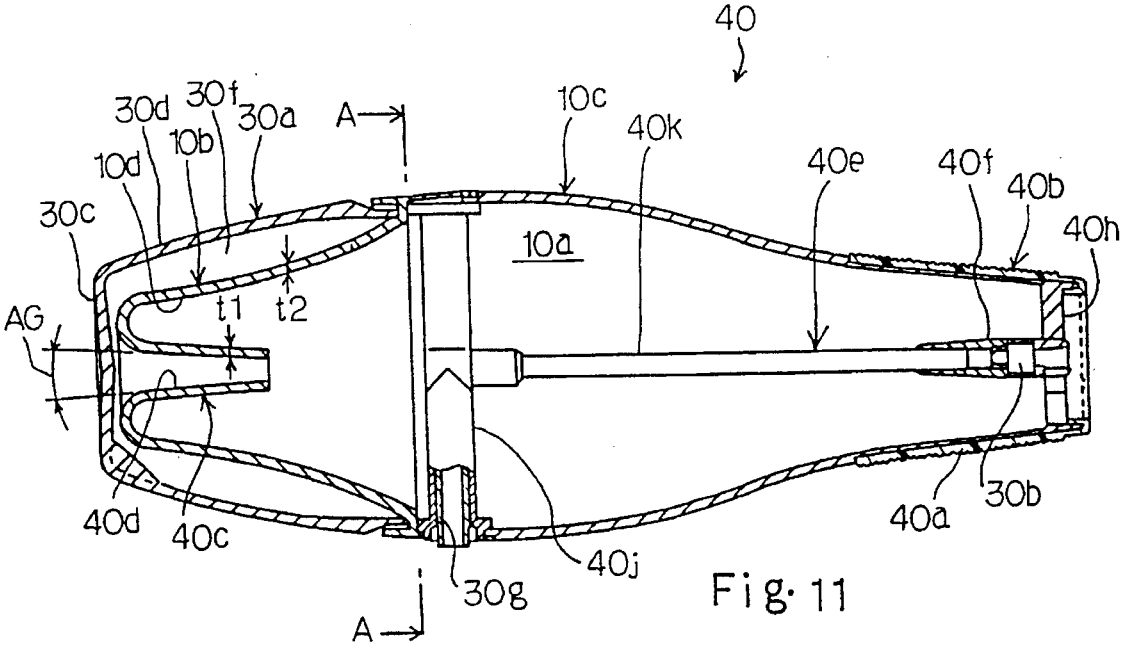
Figure 10:
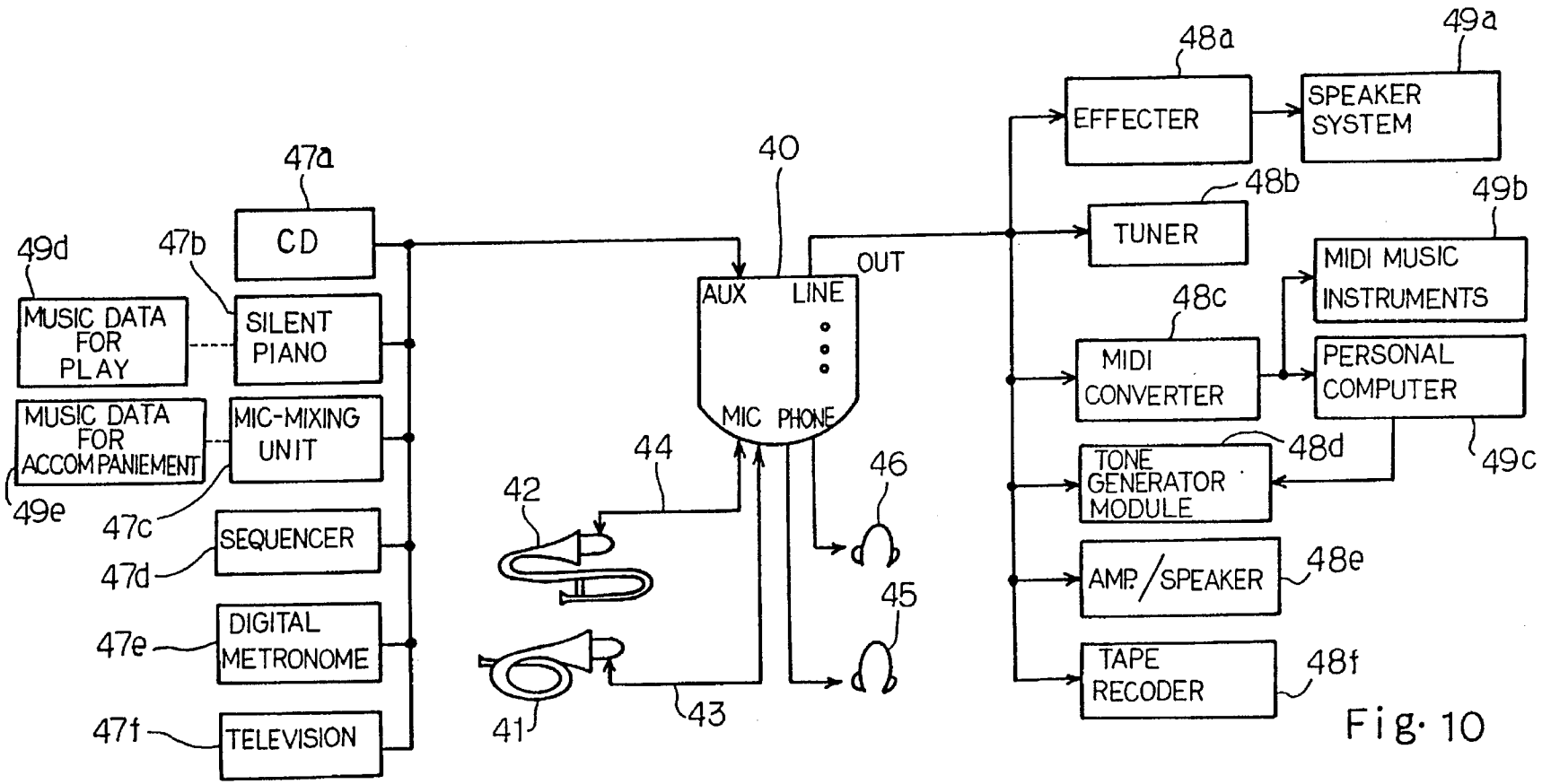
Figure 12:
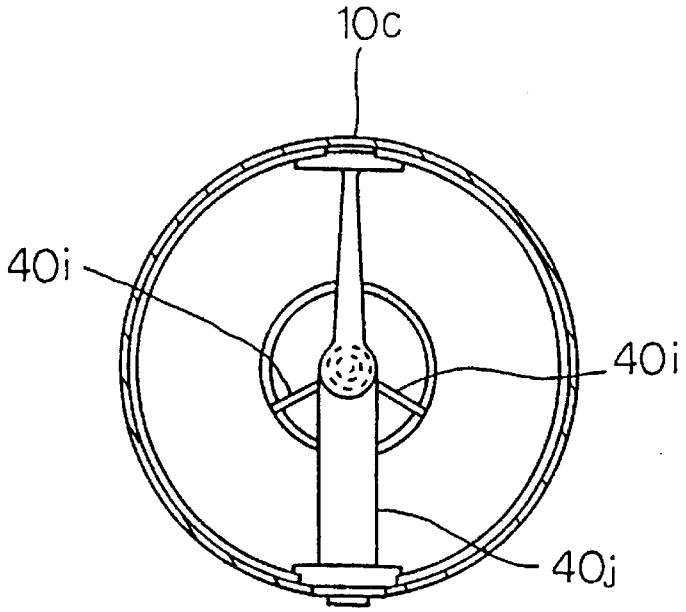
Figure 13:
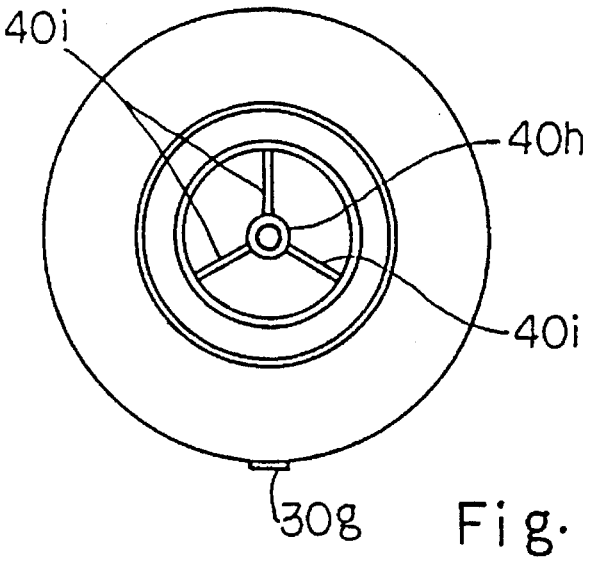
Figure 14:
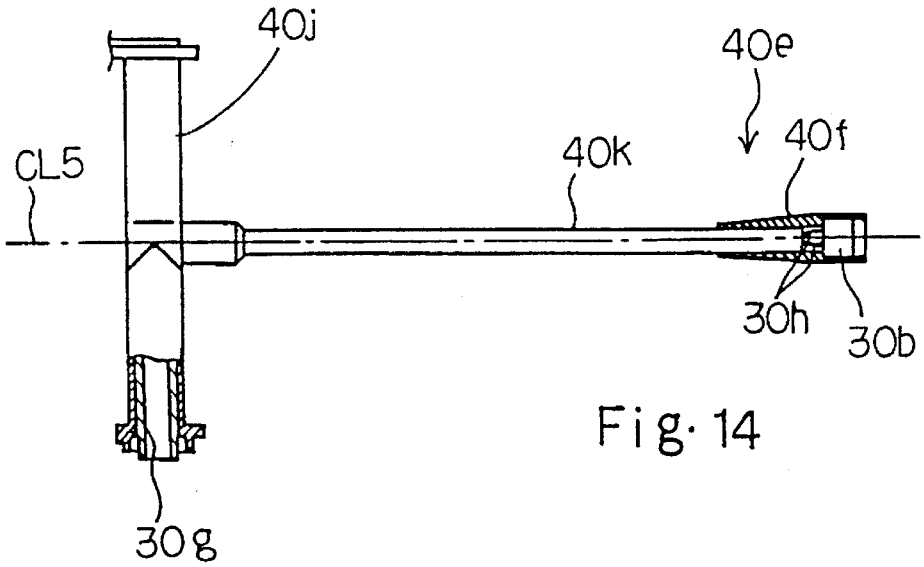
Figure 15:
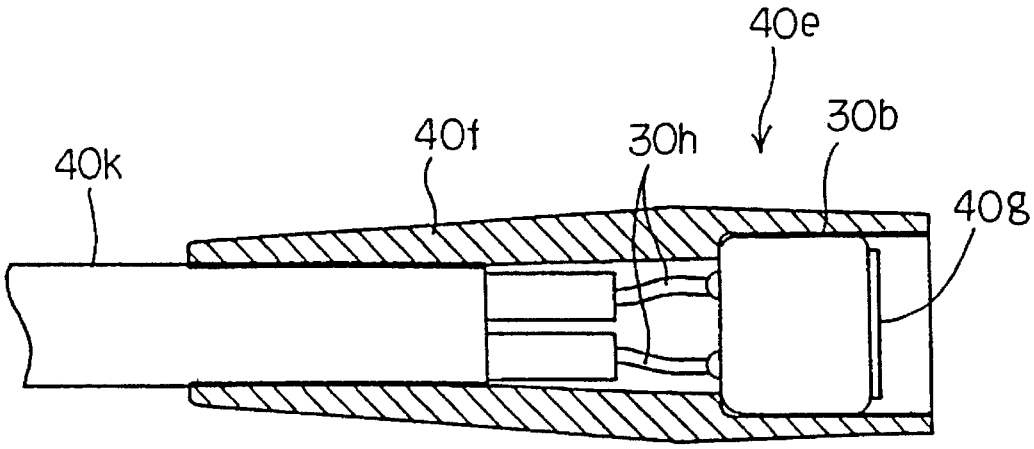

3 is a partially cut-away side view showing yet another prior art mute attached to the brass instrument;

FIG. 4 is a graph showing sound pressures of harmonic tones with and without the prior art mute shown in FIG. 2;

FIG. 5 is a partially cut-away side view showing the structure of a mute according to the present invention;

FIG. 6 is a graph showing sound pressures of harmonic tones with and without the mute shown in FIG. 5;

FIG. 7 is a partially cut-away side view showing the structure of another mute according to the present invention;

FIG. 8A is a partially cut-away plan view showing yet another mute according to the present invention;

FIG. 8B is a partially cut-away side view showing the mute shown in FIG. 8A;

FIG. 9 is a partially cut-away side view showing a sound isolating cover member incorporated in the mute shown in FIGS. 8A and 8B;

FIG. 10 is a diagram showing an electronic sound generating system connectable to a microphone incorporated in the mute shown in FIG. 9;

FIG. 11 is a cross sectional side view showing still another mute according to the present invention;

FIG. 12 is a cross sectional view taken along line A—A of FIG. 11 and showing the inside structure of the mute;

FIG. 13 is a back view showing the mute;

FIG. 14 is a partially cut-away side view showing a microphone unit incorporated in the mute; and FIG. 15 is a cross sectional side view showing a microphone forming a part of the microphone unit.

DESCRIPTION OF THE PREFERRED EMBODIMENTS

First Embodiment

Referring first to FIG. 5 of the drawings, a mute 10 embodying the present invention is inserted into a trumpet 11. The mute 10 is formed of paper, wood, metal or synthetic resin, and defines an inner space 10*a* open at both ends thereof. The inner surface of the mute 10 is axially enlarged in diameter from the right end RE toward a middle point MDL, and is axially shrunk from the middle point MDL toward the left end LE. Therefore, the inner space 10*a* has the maximum diameter at the middle point MDL. If the maximum diameter is positions around a third of the length of the mute along the center axis CL4, the sound reduction characteristics are optimized for the trumpet 11.

Two generally frusto-conical tube members 10*b* and 10*c* are assembled with one another at the middle point MDL. The generally frusto-conical tube member 10*b* may be fixed to the other generally frusto-conical tube member 10*c*.

The inner surface 10*d* of the generally frusto-conical tube member 10*b* is outwardly warped, and, accordingly, the gradient is increased from the left end LE toward the middle point MDL.

The generally frusto-conical tube member 10*b* has a turn-back portion 10*e* projecting into the inner space 10*a*, and the turn-back portion 10*e* has a frusto-conical configuration. The turn-back portion 10*e* is coaxial with the generally frusto-conical tube member 10*b*, and shares the center axis CL4 therewith. The inner diameter of the turn-back portion 10*e* is decreased from the left end LE to the leading end 10*f* thereof.

When the mute 10 is snugly inserted into the bell 1*a* of the trumpet 11, the leading end 10*f* is positioned at a predetermined point. The predetermined point is farther from the left end LE than a first point where the maximum sound pressure takes place in the inner space 10*a* and closer to the left end LE than a second point where the final nodes of standing waves take place in the inner space 10*a*. Namely, the predetermined point takes place between the first point and the second point. The reason for the predetermined point is that, though the final nodes of the standing waves strongly affect the pitch of the sound, the final nodes of the harmonic tones differently take place as will be described hereinlater.

The air passage at the leading end 10*f* is approximately equal in cross section to the air passage of the mouthpiece 11*b* of the trumpet 11. In general, if the air passage at the leading end 10*f* is wider than the air passage of the mouthpiece 11*b*, a player easily blows on the mouthpiece 11*b*, however, leakage sound is increased. On the other hand, if the air passage at the leading end 10*f* is narrower than the air passage of the mouthpiece, the leakage sound is decreased, however, the player is required to strongly blow on the mouthpiece 11*b*. Thus, there is a trade-off between the sound reduction capability and the playability. However, if the air passage at the leading end 10*f* is equal in cross section to the air passage of the mouthpiece 11*b*, the designer compromises the sound reduction capability with the playability. The standard mouthpiece 11*b* of a trumpet has the diameter of 4.2 millimeters at the minimum cross section, and the inner diameter at the leading end 10*f* is also regulated to 3.65 millimeters.

On the other hand, the generally frusto-conical tube member 10*c* linearly increases the inner surface from the right end RE and changes the increment on the way to the middle point MDL. The gradient is firstly increased and, thereafter, decreased so as to form a convex outer surface.

A sealing member 10*g* of cork is attached to the outer surface of the straight portion of the frusto-conical tube member 10*c*, and is effective against leakage air. The sealing member 10*g* effectively reduces the leakage sound, and does not allow the mute 10 to be unintentionally detached from the trumpet 11.

The present inventors measured sound pressures of harmonics of a sound generated by the trumpet with and without the mute 10 according to the present invention. The sound pressures were plotted in FIG. 6. The dispersion of the sound pressure took place like a standing wave.

Broken lines BL10, BL11, BL12 and BL13 represented the sound pressures of the second, fourth, sixth and eighth harmonic tones of the sound generated by the trumpet 11 without the mute 10, and real lines RL10, RL11, RL12 and RL13 stood for the sound pressures of the second, fourth, sixth and eighth harmonic tones of the sound generated by the trumpet equipped with the mute 10 according to the present invention. The broken lines BL12 and BL13 were overlapped with the real lines RL12 and RL13, respectively.

The maximum sound pressures took place at points MX1, MX2, MX3 and MX4, and the final nodes of the standing waves RL10 to RL13 were at points FN1, FN2, FN3 and FN4 in the inner space 10*a*. The leading end 10*f* was positioned between the points MX1 to MX4 and the points FN1 to FN4.

The final nodes FN1 to FN4 are very close to the final nodes of the standing waves represented by the broken lines BL10 to BL13, and are adjacent to the opening end of the bell 11*a*. The small difference between the final nodes is derived from the configuration of the inner surface 10*d*. In detail, the inner surface 10*d* and the outer surface of the turn-back portion 10*e* define a taper reflecting surface, and the taper reflecting surface reflects the harmonic tones at different points. In other words, the harmonic tones have respective reflection points individually deviated along the center axis CL4. Even if the player changes the pitch of the sound, the harmonic tones of the new sound find respective reflecting points on the taper reflecting surface, and the harmonic tones also concentrate the final nodes around the open end of the bell 11*a*. Thus, the harmonic tones do not widely change the final nodes FN1 to FN4, and the final nodes FN1 to FN4 are close to the final nodes of the harmonic tones generated by the brass instrument without the mute 10. These final nodes FN1 to FN4 enhance the stability of the pitch of the sound and the intervals of the tones of the sounds.

Figure 3:
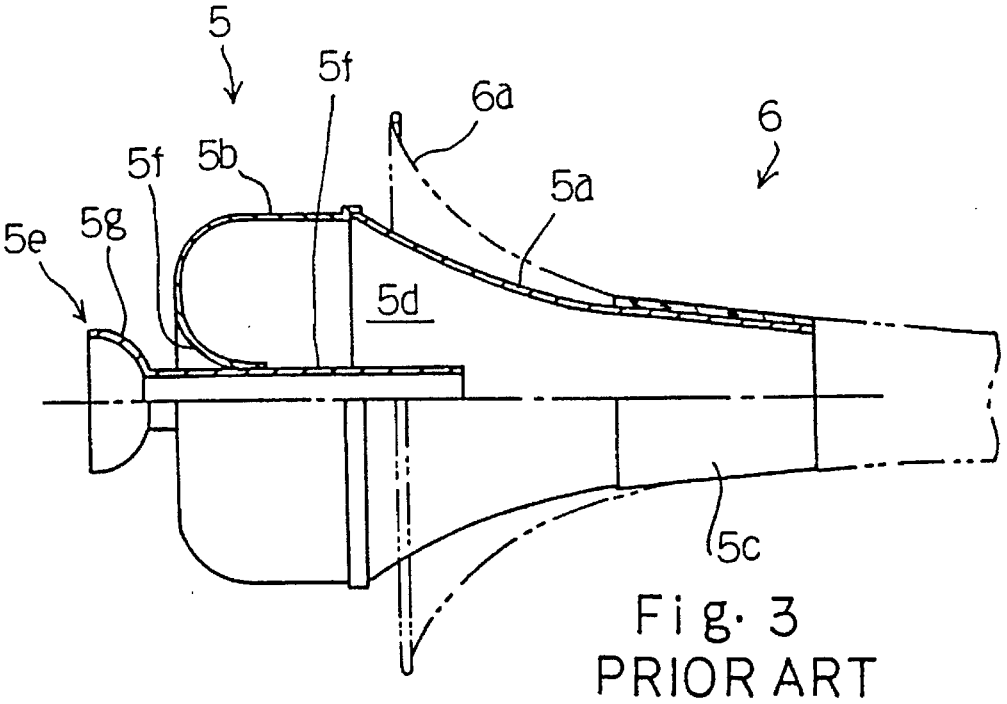
Fig. 3 PRIOR ART

The inner surface 10*d* is outwardly warped, and the inner surface of the frusto-conical tube member 10*c* inwardly warped. This surface configuration is conducive to not only the stability of the intervals but also the sound reduction, the balance of the loudness between the sounds and a stable playability in comparison with the prior art mutes is shown in FIGS. 2 and 3.

The turn-back portion 10*e* defines an inner space increasing the cross section from the leading end 10*f* toward the left end open to the air. This feature enhances the stability of the air flow passing therethrough, and provides comfortable resistance of blow to the player. Even if the player changes the blow in crescendo, the sound does not fluctuate.

The leading end 10*f* is positioned between the final nodes FN1 to FN4 and the points MX1 to MX4 of the maximum sound pressure, and the brass instrument 11 with the mute 10 not only stably generates sounds over the scale but also achieves large sound reduction.

The leading end 10*f* is adjusted to a point MIN where the minimum sound pressure due to representative harmonic tones takes place, and the adjustment maximizes the sound reduction. The point of the maximum sound pressure MX1/MX2/MX3/MX4 and the point of the minimum sound pressure are variable depending upon the harmonic tones which are taken into account. The representative harmonic tones are defined as "harmonic tones which give the unique timbre to the brass instrument". The eighth harmonic tone to the twelfth harmonic tone are the representative harmonic tones of the trumpet. The trumpet has the point of the minimum sound pressure at 30 millimeters from the left end of the mute 10 open to the air.

Second Embodiment

Turning to FIG. 7 of the drawings, another mute 20 embodying the present invention largely also comprises two frusto-conical tube members 20*a* and 20*b* assembled together, and is inserted into a bell 21*a* of a brass instrument 21. A small frusto-conical tube member 20*c* projects from the left end of the frusto-conical tube member 20*a* into an inner space 20*d* defined in the mute 20 as similar to the mute 10.

The frusto-conical tube members 20*a* and 20*b* have respective straight inner surfaces 20*e* and 20*f*, and the other features are similar to those of the first embodiment. The frusto-conical tube members 20*a* and 20*b* with the straight inner surfaces 20*e* and 20*f* are easily manufactured, and decrease the production cost of the mute 20. The taper inner space between the large and small frusto-conical tube members 20*a* and 20*c* achieves the stable sounds and a good sound reduction.

Third Embodiment

FIGS. 8A and 8B illustrate yet another mute 30 embodying the present invention used for a brass instrument 31. The mute 30 is designed on the basis of the mute 10, and the same references as those in FIG. 5 are labeled with corresponding components parts of the mute 30 without detailed description for the same of simplicity.

The mute 30 further comprises a sound insulating cover member 30*a* attached to the generally frusto-conical tube members 10*b* and 10*c* and a built-in microphone 30*b* accommodated in the inner space 10*a*.

As will be better seen in FIG. 9, the sound insulating cover member 31 is shaped in a cup-like configuration, and is formed of synthetic resin or metal. In detail, the sound insulating cover member 31 has a bottom wall 30*c* and a side wall 30*d* merged with the bottom wall 30*c*. The side wall 30*d* is inserted into a groove formed in the generally frusto-conical tube member 10*b* so as to attach the sound insulating cover member 30*a* thereto. The side wall 30*d* is partially cut away at intervals so as to form vent holes 30*e*.

The frusto-conical tube member 10*b* and the sound isolating cover member 30*a* attached thereto form an inner space 30, and a gap takes place between the bottom wall 30*c* and the left end of the frusto-conical tube member 10*b*. As a result, the inner space 30*f* is connected through the gap and the inner space of the turn-back portion 10*e* to the inner space 10*a*. The air is blown through the narrow gap between the sound insulating cover member 30*c* and the frusto-conical tube member 10*b*, and expands in the wider inner space 30*f*. The sound carried on the air is decayed, and the narrow gap and the wide inner space 30*f* serves as a muffler like that of a car.

The vent holes 30*e* are open to the air, and the inner space 30*f* is conducted through the vent holes 30*e* to the air. The vent holes 30*e* do not provide resistance against the blow larger than the resistance of the brass instrument 31. When a player generates low-pitch sound, the amount of air to be blown is increased, and the designer takes the variation of the blow into account in the design work on the vent holes 30*e*.

In this instance, the sound insulating cover member 30*a* has six vent holes 30*e* angularly spaced at 60 degrees around the periphery of the side wall 30*d*. Each of the vent holes 30*e* is elongated hole of 3 millimeters in width, and the total opening area of the vent holes 30*e* is twice to eighth times larger than the opening at the leading end 10*f*. It is preferable for the vent holes 30*e* to be four times to six times wider than the opening at the leading end 10*f*.

A jack 30*g* is embedded into the frusto-conical tube member 10*c* adjacent to the middle point MDL, and is connected through wires 30*h* to the microphone 30*b*. The microphone 30*b* is located at the point M (see FIG. 6) where the effective standing waves are terminated, and the point M is close to the right end of the mute 30 in this instance. The jack 30*g* is either male or female type.

Low-order harmonic tones put nodes around the point M, and high-order harmonic tones put anti-nodes around the point M. For this reason, the volume and the timbre are constant over the scale.

The mute 30 achieves the stability of the pitch as similar to the first embodiment, and the sound insulating cover member 30*a* further improves the sound reduction. In fact, when a player blows on the mouthpiece (not shown) of the brass instrument 31, he only hears vent noise. The inner space 30*f* eliminates high frequency components from the vent noise, and the vent noise is small.

The vent holes 30*e* are open along the boundary between the frusto-conical tube members 10*b* and 10*c*, and are hardly noticed. Therefore, the external appearance of the mute 30 is attractive.

The player can confirm the sounds through the microphone 30*b* and enjoy an ensemble performance together with other electronic musical instrument without acoustic sounds.

The microphone 30*b* is coupled to a sound processing system 40 shown in FIG. 10. A mixing/amplification unit with a digital reverb and a module with a reverb are incorporated in the sound processing system 40. The mutes 30 are respectively attached to a trumpet 41, a trombone 42 and a horn, and the microphones 30*b* in the mutes 30 are coupled through wirings 43 and 44 to input terminals MIC of the sound processing system 40. Head-phones 45 and 46 are respectively connected to output terminals PHONE of the sound processing system 40.

The sound processing system 40 further has auxiliary input terminals AUX assigned to a compact disk unit CD, a silent piano 47*b*, a mic-mixing unit 47*c* for a singer, a sequencer 47*d*, a digital metronome 47*e* and a television set 47*f* and auxiliary output terminals LINE assigned to an effecter 48*a*, a tuner 48*b*, a MIDI (Musical Instruments Digital Interface) converter 48*c*, a tone generator module 48*d*, an amplifier/speaker 48*e* and a tape recorder 48*f*. The effecter 48*a* is connected to a speaker system 49*a*, and the MIDI converter 48*c* is coupled to MIDI musical instruments 49*b* and a personal computer 49*c*. The personal computer 49*c* is further coupled to the tone generator module 48*d*.

The sound processing system 40 allows a player to enjoy an ensemble as follows.

While the compact disk unit 47*a* or the television unit 47*f* is reproducing music, the player blows on either trumpet 41 or trombone 42, and imparts a suitable reverb to the sound generated by the brass instrument. The player or listeners hear the ensemble through the headphones 45 and 46, or records it through the tape recorder 48*f*.

While the silent piano 47*b* or the mic-mixing unit 47*c* is reproducing music recorded on a floppy disk 49*d* or 49*e*, the player blows on the brass instrument 41 or 42, and hears electronic sounds through the headphone 45 or 46.

Using the digital metronome 47*e* and the tuner 48*b*, the player can practice a music. The metronome 47*e* gives a tempo through the headphone 45 or 46, and guides the player. The sound processing system 40 imparts a suitable reverb to the sounds generated by the brass instrument 41 or 42, and the player conforms the sounds through the headphone 45 or 46 and the indication of the tuner 48*b*.

While the player is blowing on the brass instrument 41 or 42, the effecter 48*a* changes the timbre of the brass instrument 41 or 42 to an arbitrary timbre, and the speaker system 49*a* reproduces the performance through the selected timbre.

While the player is blowing on the brass instrument 41 or 42, the MIDI converter 48*c* changes the music data signal representative of a series of sounds into a series of MIDI data codes, and the tone generator module 48*d* and the amplifier/speaker 48*e* reproduces the sounds through another timbre such as, for example, a piano or a synthesizer.

If the MIDI data codes are supplied to the personal computer unit 49*a* together with MIDI codes for other parts, the personal computer unit 49*c* prepares a complete score.

If the modules are multiplied, sounds of the brass instrument 41 or 42 are recorded without an undesirable influence of other musical instrument in a narrow room. Moreover, good reverb is imparted to the sounds without a special recording studio.

The personal computer 49*a* evaluates a performance through comparison between the sounds generated by the brass instrument and the sounds of a standard performance.

If the auxiliary output terminal LINE is suitably connected to the auxiliary input terminal AUX, players respectively blow on the brass instruments 41 and 42, and hear the ensemble through the headphones 45 and 46.

If a transmitter is incorporated in the sound processing system 40, the music data representative of the sounds are transferred to a receiver at a long-distance place.

Fourth Embodiment

FIGS. 11 to 13 illustrate still another mute 40 embodying the present invention. The mute 40 is designed on the basis of the mute 30, and for this reason, references designating parts of the mute 30 are labeled with the corresponding components parts of the mute 40 without detailed description. The mute 40 differs from the mute 30 as follows.

First, a seal layer 40*a* of synthetic resin is wound on the felt side portion of the frusto-conical tube member 10*c* instead of the cork layer 10*g*. Silicon rubber is available for the seal layer 40*a*. A plurality of grooves 40*b* are formed on the outer surface of the seal layer 40*a* like a ripple, and enhances friction between the seal layer 40*a* and the bell of a brass instrument (not shown).

Second, a frusto-conical tube member 40*c* is thicker than the generally frusto-conical tube member 10*b*. Namely, the thickness t1 is larger than the thickness t2, and is equal to or greater than 2 millimeters. The frusto-conical tube member 40*c* thicker than 2 millimeters makes low-pitch sounds stable, and effective against noise due to edge-tone phenomenon.

Third, the frusto-conical tube member 40*c* has an inner surface 40*d* shaped by rotating a trapezoid defined by angle AG. The angle AG ranges from 5 degrees to 15 degrees, and the player feels the blow through the inner surface 40*d* natural. If the angle AG is less than 5 degrees, the player feels the resistance of the frusto-conical tube member 40*c* heavy. On the other hand, if the angle AG is greater than 15 degrees, the air flow is disturbed, and the player feels the blow unstable. In case of a trumpet, it is preferable to adjust the angle AG to 7 degrees.

Fourth, the microphone 30*b* is integrated into a microphone unit 40*e* together with the wires 30*h*. In detail, the microphone 30*b* is inserted into a tube-shaped microphone holder 40*f* (see FIGS. 14 and 15), and is open to the inner space of the brass instrument (not shown). A thin sheet of synthetic resin such as polyester is provided between the inner surface of the tube-shaped microphone holder 40*f* and the microphone 30*b*, and the microphone 30*b* is fixed to the inner surface of the microphone holder 40*f* by means of adhesion compound. The thin sheet changes the frequency characteristics of the microphone 30*b*, and causes the sound processing unit 40 to generate sounds close to the acoustic sounds of the brass instrument. The microphone holder 40*f* is fixed to a ring-shaped bracket member 40*h*. Arms 40*i* are connected to the ring-shaped bracket member 50*h*, and are angularly spaced from one another. The arms 40*i* are held in contact with the inner surface of the generally frusto-conical tube member 10*c*, and maintain the relative position between the generally frusto-conical tube member 10*c* and the microphone holder 40*f* and, accordingly, the microphone 30*b*.

The microphone unit 40*e* further includes a jack holder 40*j*, and the jack 30*g* is retained by the jack holder 40*j* in such a manner as to be exposed to the outside. The jack holder 40*j* is placed in the inner space 10*a* with the maximum diameter, and is fixed to the generally frusto-conical tube member 10*c*. The projecting portion of the jack 30*g* is threaded, and a lock nut (not shown) is meshed with the threaded projecting portion so as not to fall a plug ( not shown ) from the jack 30*g*.

The microphone unit 40*e* further includes a wire case 40*k* connected between the jack holder 40*j* and the microphone holder 40*f*. The wires 30*h* extend inside of the wire case 40*k* along the center axis of the mute 40 CL5, and connect the microphone 30*b* to the jack 30*g*.

Thus, the microphone 30*b* is integrated into the microphone unit 40*e*, and the microphone unit 40*e* is easily assembled with the frusto-conical tube member 10*c*. This results in reduction of production cost. Moreover, the microphone holder 40*h*, the wire case 40*k* and the jack holder 40*j* maintain the relative positions among the microphone 30*b*, the wires 30*h* and the jack 30*g*, and, for this reason, prevent an electric signal propagated through the wires 30*h* from noise due to undesirable physical vibrations on these components.

As will be appreciated from the foregoing description, the inner space of the mute according to the present invention is shaped in such a manner that the standing waves of the representative harmonic tones have the final nodes close to those of the standing waves generated without the mute, and the intervals among the notes do not fluctuate.

The leading end of the frusto-conical tube member is located at a position where the minimum sound pressure due to standing waves of representative harmonic tones featuring the brass instrument takes place, and enhances the sound reduction.

Moreover, the frusto-conical tube member 10*e*, 20*c* or 40*c* projects into the inner space, and the player does not feel the blow unnatural.

The inner surface of the frusto-conical tube members 10*b*/10*c* or the variation of the gradient enhances the balance of the intervals.

The frusto-conical tube member with the angle between 5 degrees and 15 degrees makes the player feel the blow natural, and the thickness not less than 2 millimeters enhances the stability of the low-pitch tones.

The built-in microphone allows a player to practice the brass instrument without disturbance to the neighbors. If the microphone is placed at the terminated position of the standing waves of the representative harmonic tones in the bell, the microphone picks up the sounds without change of timbre and loudness.

If the sound insulating cover member is further attached, the acoustic sounds are eliminated by the sound insulating cover member perfectly. The inner space between the sound isolating cover member and the frusto-conical tube member is two to eight times wider in cross section than the inner space of the inwardly projecting frusto-conical tube member, and the sound insulating cover member does not increase the resistance against the blow.

Relation Between Principle of the Invention and Embodiment

When a player blows on a brass instrument, an acoustic wave is generated, and is partially radiated from the inner space of the brass instrument to the outside. The acoustic wave is partially reflected around the outlet end of the brass instrument due to a difference in acoustic impedance between the inner space and the outer space, and is backwardly propagated toward the inlet end. Thus, a reverse acoustic wave is created through the reflection.

The reverse acoustic wave interferes with the acoustic wave, and, as a result, a standing wave takes place inside of the brass instrument.

Even though the acoustic wave is reflected around the outlet end of the brass instrument, the acoustic wave in part is radiated from the outlet end. For example, a trumpet radiates the vibrational energy of the standing wave at only 1 or less than 1 percent. The remaining energy is partially consumed in the friction between the vibrative column of air and the inner surface of the brass instrument, and is partially converted to heat.

In order to mute an acoustic sound generated by a brass instrument, it is a basic concept to reduce the vibrational energy of the standing wave radiated from the outlet end. High frequency components are much liable to be radiated. One of the approaches to reduce the vibrational energy radiated from the outlet end is to decrease the area of the outlet end of the brass instrument.

However, if the area of the outlet end is too narrow, the blow can not escape from the inner space, and the player feels not comfortable. For this reason, it is necessary to design a vent at least equal in area to the minimum cross section of the air passage in the mouthpiece.

When the prior art mute is attached to the flare or the bell of a brass instrument, the pitch of sound is increased by a semitone. This is because of the fact that the prior art mute changes the boundary condition of the resonance from an open end to a closed end. Even if the prior art mute has a vent, the vent is too narrow to serve as the open end, and the boundary condition is assumed to be the closed end. The change of the boundary condition results in that the vibrative column of air is prolonged by a quarter wavelength of each frequency component of the standing wave.

The additional quarter wavelength is conventionally not taken into account, and the prior art mute suffers from the increase of the pitch of sound.

It is necessary to provide a counter measurement against the change of the boundary conduction. The present inventor noticed that if the reflection surface of a mute was deviated by a quarter wavelength, the standing wave generated in the brass instrument equipped with the mute was matched with the standing wave generated in the brass instrument without the mute.

The standing wave generated in a brass instrument without the mute and the standing wave generated in the brass instrument with a mute are hereinbelow referred to as "original standing wave" and "modified standing wave", respectively. When the quarter wavelength is canceled by a prolonged vibrative column of air, a regulated standing wave takes place inside of the brass instrument.

In order to match the original standing wave with the corrected standing wave, the present inventors provided a regulative portion to a mute between the outlet end of a brass instrument and the reflection surface of the acoustic wave. The regulative portion is implemented by the frusto-conical tube member such as 10*c*, and the frusto-conical tube member 10*c* theoretically changes the reflection surface from the outlet end of the bell portion 11*a* to the middle point MDL. As a result, the vibrative column of air is prolonged by the quarter wavelength.

It is natural for the regulative portion to be increased in cross section toward the reflection surface like the bell portion of a brass instrument so as to exactly prolong the vibrative column of air. In other words, it is theoretically desirable for the regulative portion to have a horn configuration, the cross section of which is gradually increased toward the reflection surface like the bell of the brass instrument.

The present inventor evaluated various configurations, and concluded that an exponential horn configuration was appropriate. However, the exponential horn configuration was required to be modified as similar to the horn configuration of the bell portion, and partially bulged out. The modified exponential horn configuration enhances the balance of tones on the scale.

If the acoustic wave was constituted by a single frequency component, the regulative portion would eliminate the undesirable increase of pitch. However, various frequency components form the actual acoustic wave, and a vertical reflection surface is not always appropriate to all of the frequency components. In fact, a vertical reflection surface optimum to a fundamental frequency component is not appropriate to higher harmonic frequency components. For this reason, the reflection surface is modified so as to disperse the reflecting points of the frequency components. The dispersion of the reflecting points is expected to achieve the resonance of vibrative columns of air different in length.

The present inventors form the reflecting surface with continuously oblique surface projecting from the regulative portion. The cross section defined by the continuously oblique surface is decreased in by spacing from the regulative portion. The continuously oblique surface is, by way of example, formed by the inner surface 10*d* of the tube member 10*b* and the inner surface of the turn-back portion. It is desirable for the continuously oblique surface to have an inverted exponential horn configuration, and the cross section is exponentially decreased toward the open end to the outside. In the first embodiment, the leading end 10*f* forms the open end.

The turn-back portion shortens the total length of the oblique reflection surface. The present inventors confirmed that the inner surface of the turn-back portion did not deteriorate the wave-reflecting characteristics, the stability of the tones, player's impression on the blow and the tone quality of the low-pitch tones. The low-pitch tones are rather improved. High-pitch tones are stimulative. If the dispersion of sound pressure of a high-pitch tone is deviated toward a low pressure position, the high-pitch tones are comfortable for a listener.

Although particular embodiments of the present invention have been shown and described, it will be obvious to those skilled in the art that various changes and modifications may be made without departing from the spirit and scope of the present invention. For example, the brass instrument may be a French horn, a trombone or a tuba, and the inner configuration of the mute is tailored in consideration of the representative harmonic tones.

What is claimed is:

1. A mute attached to a bell portion of a brass instrument, comprising:

a case member including a first inner surface defining a first inner space having a first end connected to an air passage of said brass instrument and a second end open to the outside; and a frusto-conical tube member connected to said case member at said second end, and projecting into said first inner space, said frusto-conical tube member including a second inner surface defining a second inner space decreasing in cross section toward a leading end thereof.

2. The mute as set forth in claim 1, in which said leading end of said frusto-conical tube member is located at a position where the minimum sound pressure due to standing waves representative of predetermined harmonic tones featuring said brass instrument takes place.

3. The mute as set forth in claim 2, in which said brass instrument is a trumpet, and said predetermined harmonic tones are the eighth harmonic tone to the twelfth harmonic tones.

4. The mute as set forth in claim 1, in which said first inner space increases a cross section thereof from said first end to a middle point and decreases said cross section thereof from said middle point to said second end.

5. The mute as set forth in claim 4, in which an increment of said cross section is constant from said first end to a first certain point on the way to said middle point, an is increased from said first certain point to a second certain point on the way of said middle point and is decreased from said second certain point to said middle point, a decrement of said cross section being decreased from said middle point to said second end.

6. The mute as set forth in claim 4, in which an increment of said cross section is constant from first end to said middle point, and an decrement of said cross section is constant from said middle point to said second end.

7. The mute as set forth in claim 1, in which said first inner space increases a cross section thereof from said first end to a middle point and decreases said cross section thereof from said middle point to said second end, said leading end being farther from said second end than first points in said first inner space and closer to said second end than second points in said first inner space, the maximum sound pressures of harmonic tones of a sound generated by said brass instrument attached to said mute taking place at said first points, final nodes of standing waves respectively representative of dispersions of sound pressures of said harmonic tones taking place at said second points.

8. The mute as set forth in claim 1, further comprising a sound insulating cover member partially covering an outer surface of said case member so as to define a third inner space contiguous to said second inner space through a gas formed between a third inner surface of said sound insulating cover member and an outer surface of said case member, said third inner space being open through an air vent to the outside of said mute.

9. The mute as set forth in claim 8, in which said third inner space has a cross section larger in area than said gap.

10. The mute as set forth in claim 8, in which said third inner space has a cross section larger in area than said gap, and said air vent is twice to eighth times larger in area than said cross section of said second inner space.

11. The mute as set forth in claim 1, further comprising a microphone accommodated in said first inner space so as to pick up sounds generated by said brass instrument.

12. The mute as set forth in claim 11, in which said microphone is connected through wires to a jack, and said microphone, said wires and said jack are integrated into a microphone unit accommodated in said mute.

13. The mute as set forth in claim 11, in which said microphone is connected through wires to a jack, and said microphone, said wires and said jack are integrated into a microphone unit accommodated in said mute.

14. The mute as set forth in claim 1, further comprising a sound insulating cover member partially covering an outer surface of said case member so as to define a third inner space contiguous to said second inner space through a gas formed between a third inner surface of said sound insulating cover member and an outer surface of said case member, said third inner space being open through an air vent to the outside of said mute, and a microphone accommodated in said first inner space so as to pick up sounds generated by said brass instrument.

* * * * *